US005512149A

United States Patent [19]

MacKenna IV

[11] Patent Number: 5,512,149

[45] Date of Patent: Apr. 30, 1996

[54] SACRIFICIAL ANODE DEVICE WITH OPTIMIZED ANODE/CATHODE INTERFACE SURFACE CONTACT AREA

[76] Inventor: Gilbert J. MacKenna IV, 36 St. James Ave., Enfield, Conn. 06082

[21] Appl. No.: 299,599

[22] Filed: Sep. 1, 1994

[51] Int. Cl.[6] ..... C23F 13/00

[52] U.S. Cl. ..... 204/197; 204/280; 204/284

[58] Field of Search ..... 204/147, 148, 204/196, 197, 283–285, 280

[56] References Cited

U.S. PATENT DOCUMENTS

| | | | |
|---|---|---|---|
| 72,309 | 12/1967 | Matthew | 204/197 |
| 160,009 | 2/1975 | Donoghue | 204/197 |
| 1,851,481 | 3/1932 | Baba | 204/284 |
| 1,900,011 | 3/1933 | Durham | 204/197 |
| 2,404,031 | 7/1946 | Bunn et al. | 204/197 |
| 2,415,494 | 2/1947 | Holden | 204/284 |
| 2,619,455 | 11/1952 | Harris et al. | 204/197 |
| 2,645,612 | 7/1953 | Taylor | 204/197 |
| 2,749,299 | 6/1956 | Wheeler | 204/197 |
| 2,763,907 | 9/1956 | Douglas | 204/197 |
| 2,838,453 | 6/1958 | Randall | 204/197 |
| 3,146,182 | 8/1964 | Sabins | 204/197 |
| 3,260,661 | 7/1966 | Kemp et al. | 204/197 |
| 3,425,925 | 2/1969 | Fleischman | 204/197 |
| 3,616,422 | 10/1971 | Doremus et al. | 204/197 |
| 3,726,779 | 4/1973 | Morgan | 204/197 |
| 3,870,615 | 3/1975 | Wilson et al. | 204/197 |
| 3,893,903 | 7/1975 | Lindholm | 204/197 |
| 4,146,448 | 3/1979 | Nakano et al. | 204/148 |
| 4,397,726 | 8/1983 | Schwert | 204/147 |
| 4,506,485 | 3/1985 | Apostolos | 204/196 |
| 4,877,354 | 10/1989 | Williamson | 204/197 |

*Primary Examiner*—T. Tung
*Attorney, Agent, or Firm*—William W. Jones

[57] ABSTRACT

Metal corrosion which occurs under conditions of use is mitigated and controlled by a sacrificial anode device which can be easily attached to, and detached from the corrosion-prone object. In ambient applications, the anode and cathode components of the device may be distinct metallic elements which may be alloys, or layers of alloys, and which are configured so as to optimize the interface surface area between the anode and cathode, while being sufficiently compact to be placed essentially in any corrosion-prone location. In extremely wet applications, such as underwater, or in water circulating or storage systems, the anode may be an effectively configured block of metal, and the cathode will be the water constituent of the environment in question. The optimized anode/cathode interface area provides increased operating life for the device, reduces material waste, and strengthens the structure of the device.

4 Claims, 4 Drawing Sheets

SACRIFICIAL ANODE DEVICE WITH OPTIMIZED ANODE/CATHODE INTERFACE SURFACE CONTACT AREA

TECHNICAL FIELD

This invention relates to the mitigation and control of metal corrosion in ambient conditions, and in watery environments, and to a method and apparatus for minimizing corrosion of metal parts. More particularly, this invention relates to an anodic sacrificial device wherein the interface surface area contact between the anode and cathode components of the device is optimized so as to provide increased operational life.

BACKGROUND ART

Metal oxidizes, corrodes or rusts, causing failure of structures, devices or the like metal products. There are many types of corrosion, all of which are basically due to the tendency of a refined metal to form a more stable compound. Therefore, manufactured metals have a tendency to corrode thus losing their desired properties, and failing to satisfy their intended uses over time.

Prevention or reduction of corrosion is usually dependent on the metal and its intended use. Prior approaches to controlling metal corrosion include special surface coatings, moisture absorbers, and sacrificial anodes. Each of the aforesaid approaches suffers from certain drawbacks which are described below.

Surface Coatings:

One method of protecting metal from corroding is to try to insulate the metal from the environment that promotes corrosion. Controlled environments are expensive and impractical, thus paints and other surface coatings which are applied to the metal surfaces to be protected are common. These coatings insulate the metal surface from the ambient surroundings. Some of the paints which are applied to the metal surface contain sacrificial metal particles, such as zinc or aluminum, which are suspended or mixed into the paint, and which are intended to corrode as a sacrifice, or in place of, the metal surface being protected. The main drawback to such sacrificial surface paints is the need to frequently repaint the entire surface being protected. The paint actually corrodes on the metal surface so that before the surface can be repainted, the corroded paint residue must be chipped or scraped off of the metal surface. In applications where frequent repainting is impractical, such as with automobiles, the result will be corroded paint on an automobile, which corroded paint will eventually allow the metal to corrode. Paints which do not include anodic particles can chip, scratch or wear thereby exposing the underlying metal to corrosive ambient conditions.

Another type of coating that can protect a metal from corroding is grease or oil. In certain applications, grease and/or oil can be effective to prevent metal corrosion, but in most applications this approach will prove to be messy, and short lived, and thus impractical.

Moisture Absorption:

Moisture absorbent materials are common for use in corrosion prevention. The simple act of wiping off a wet or damp metal structure, such as a knife blade, is an example of moisture absorption used to prevent metal corrosion. Another example of moisture absorption to prevent corrosion is found in packaging, wherein silicone particles and blankets are used to absorb moisture inside of the package.

Silicone sprays are also commonly used for the same purpose. The general drawback with all moisture absorbers is that they all have a saturation point, and are not well suited for general applications. Obviously, rain would rapidly destroy the efficacy of this approach in an ambient environment.

Sacrificial Anodes:

Sacrificial anodes are the negative side of a cathode/anode circuit. The cathode is the positive side, and the anode is a solid piece of metal which freely gives up electrons due to its atomic composition. Three metals commonly used as the anode electron donor are zinc, aluminum, and magnesium. Typically, the metal anode will be connected to the metal to be protected by a ground strap, or by forming threads on one end of the metal anode body and screwing the anode into a tapped port in the metal being protected. A drawback with present day anodes is the fact that they tend to degrade unevenly, and often end up being adhered to the part they are protecting by anodic corrosion. Since the anodes must be periodically replaced, this adherance is undesirable. Still another problem with present day sacrificial anodes is the fact that frequently the poor consumption patterns and uneven degradation will result in pieces of the anode breaking away, which can result in problems in a circulating fluid system.

It would be very desirable to provide a sacrificial anode device that would operate with consistant consumption patterns, and a longer operational life with minimal material waste. It would also be highly desirable to provide a sacrificial anode device that could be easily mounted directly on essentially any structural surface which is prone to corrosion, and could be easily replaced when necessary.

DISCLOSURE OF THE INVENTION

This invention relates to a sacrificial anode device which is configured so as to provide an optimal anode-cathode interface surface area. A first general embodiment of the invention is designed for use under essentially dry conditions; and a second general embodiment of the invention is designed for use under essentially watery conditions. In both embodiments, the sacrificial corroding anode surface of the device is configured so as to provide optimal surface contact with the cathode. The resultant anode corrosion generations will produce extended operating life and minimal material waste for the device.

In the dry environment embodiment of the invention, the anodic component of the device may be formed from an electron donor metal such as zinc, aluminum, magnesium, or the like. The cathodic component of the device may be formed from a conductive metal such as copper. Other conductive metals or alloys with low corrosive tendencies could also be used. An important faceit of the invention is to use a metal cathode which is more conductive and less corrosive than the metal which is being protected. Gold of course would be the ultimate non-corrosive conductor and cathode material, and could be used to protect circuitry in super computers or other very expensive devices. The cathode component will form an inner core part of the device, and the anode component will form an outer shell covering the cathode component. The cathode will be provided with conductive leads at opposite ends of the device. A potential difference between the two leads causes current flow through the cathode component.

One approach for increasing or optimizing the cathode-anode interface surface area, is to form the cathode component as a plurality of conductive elements, each of which are surrounded by the anode metal component. Each of the conductive elements extend from one end of the device to the other. A separate lead is connected to opposite ends of each of the conductive elements, and the leads are gathered together at each end of the device and connected to common contacts, one at each end of the device.

Another approach for increasing or optimizing the cathode-anode interface surface area is to utilize an elongated cathode element which is clad with the anode element, wherein the cathode element is configured so as to maximize the surface area internally of the device. To this end, the cathode element can be formed with a stellate cross-sectional configuration. The cathode element could also be formed with a corkscrew configuration. A combined corkscrew-stellate configuration could also be utilized.

While the aforesaid dry environment embodiment may also be used in a watery environment, a differently configured watery environment embodiment of the invention could likewise be used. In the watery environment embodiment, the sacrificial anode takes the form of a block of a properly configured electron donor metal, such as zinc, aluminum or the like, which anodic metal block will be directly secured to the body being protected from corrosion. In the watery environment, the water serves in the cathode capacity In this embodiment of the invention, the anode body is specially configured so as to optimize the surface area contact with the water cathode. The anode will be fastened to the structure being protected, and the surface on the anode will be configured so as to ensure that maximum sacrificial corrosion occurs on surfaces on the anode which are distal of the structure being protected.

It is therefore an object of this invention to provide an improved sacrificial anode structure which is configured to provide optimized surface interface area contact between the anode and a cathode in a sacrificial anode-cathode circuit.

It is a further object of this invention to provide a sacrificial anode of the character described which may be removably fastened to the structure being protected.

It is an additional object of this invention to provide a sacrificial anode of the character described which can be used in essentially dry ambient applications and which has a metallic cathode component which may be removably fastened to the structure being protected.

It is another object of this invention to provide a sacrificial anode of the character described which can be used in watery enviroment applications and which is configured so as to preferentially corrode at the areas of the anode which are most distal of the structure being protected.

These and other objects and advantages of the invention will become more readily apparent from the following detailed description of several embodiments of the invention when taken in conjunction with the accompanying drawings, in which:

DETAILED DESCRIPTION OF THE INVENTION

Figure 1:
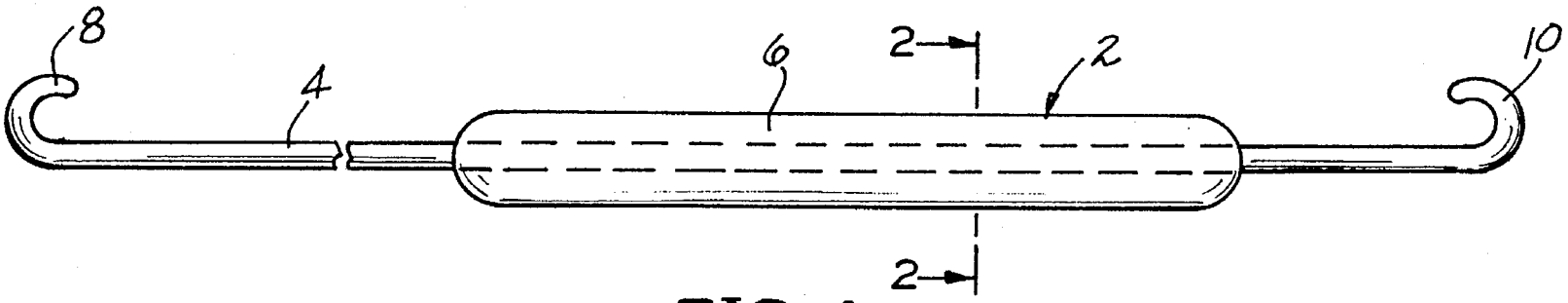
FIG. 1 is a plan view of an embodiment of the invention which is designed for use in essentially dry environment applications.
Figure 2:
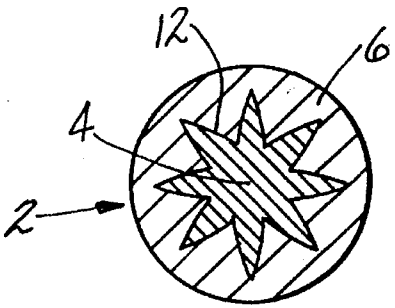
FIG. 2 is a cross sectional view taken along line 2—2 of FIG. 1.

Referring now to the drawings, there is shown in FIGS. 1 and 2 a relatively simple embodiment of the invention which is designed for use in essentially dry environmental applications. The device is denoted generally by the numeral 2 and includes a central cathodic member 4 which is medially surrounded by an anodic member 6. The cathode member 4 may be formed from heavy duty copper conductor wire and the anode member 6 may be formed from an electron donor metal such as zinc, which electron donor metal is clad onto the cathode member 4. The ends of the cathode member may be bent back, as at 8 and 10 and flattened so as to form hook-shaped contacts which facilitate securement of the device to the structure being protected. The use of an elongated cathode member 4 which extends completely through the anode member 6 provides an increased surface area interface between the cathode 4 and the anode 6. Since the interface between the cathode 4 and anode 6 is the locus of the sacrificial corrosion, the enhanced area thereof will provide longer service life and more efficient operation of the device 2 in an essentially dry environment. FIG. 2 shows the stellate outer surface 12 of the clad portion of the cathode 4 which increases the surface area of the cathode-anode interface so as to enhance the service life and efficiency of the device.

Figure 3:
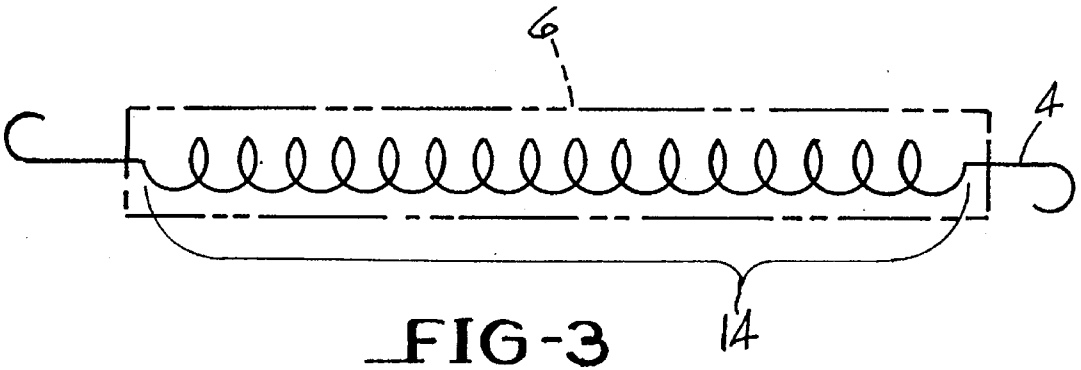
FIG. 3 is a perspective view of a corkscrew-shaped cathode member for use in the embodiment of FIG. 1.
Figure 3A:
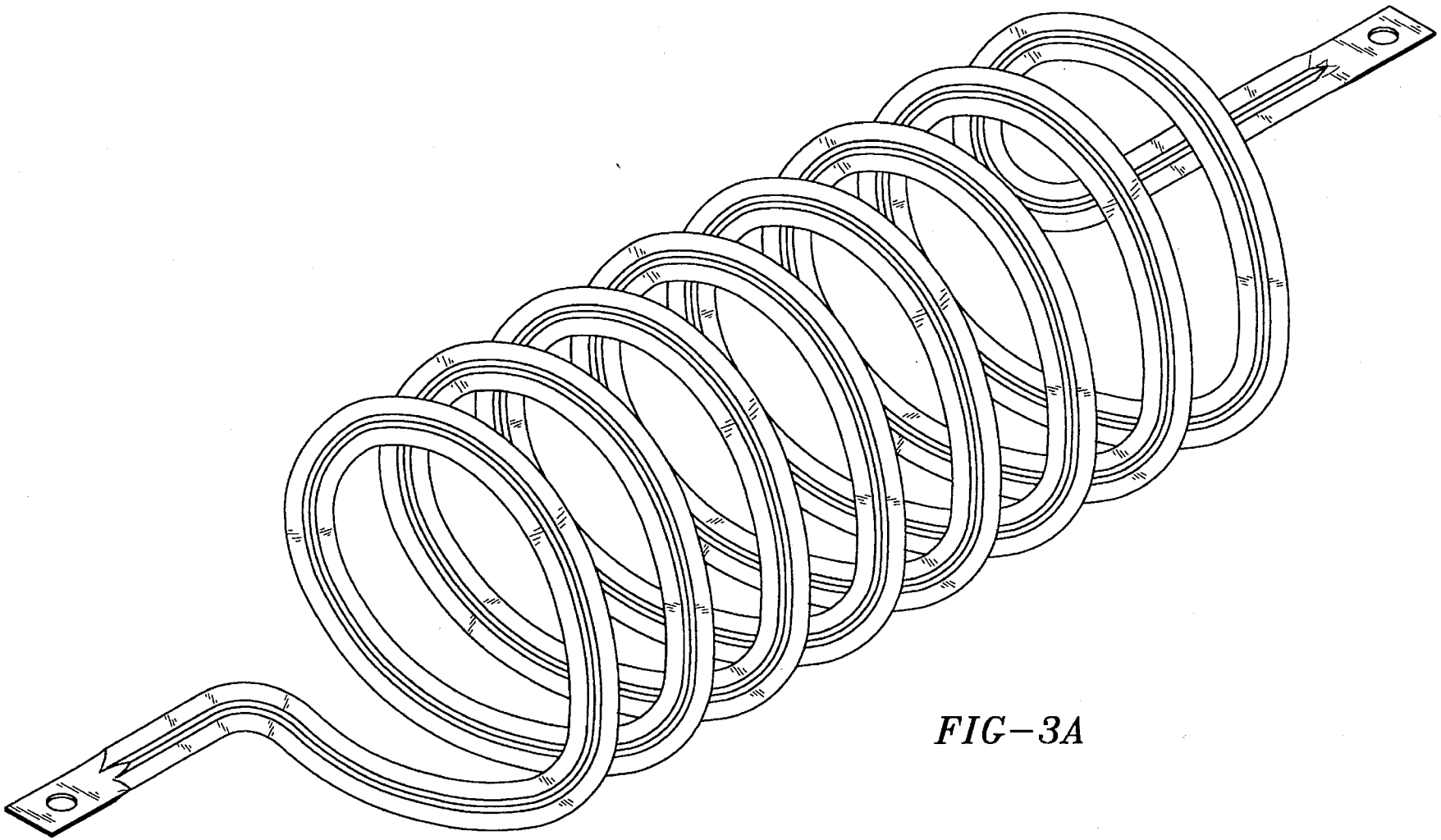
FIG. 3A is a perspective view of a corkscrew-shaped cathode member having a stellate cross-section.

FIG. 3 shows another embodiment of the device 2 wherein the medial portion 14 of the cathode member 4 has the shape of a helix or corkscrew. In this manner the portion of the cathode which is covered by the anode member 6 (shown in phantom) is increased. If so desired, the configurations of FIGS. 2 and 3 could be combined to provide a helical medial portion with a stellate cross section on the cathode member 4, or shown in FIG. 3A.

Figure 4:
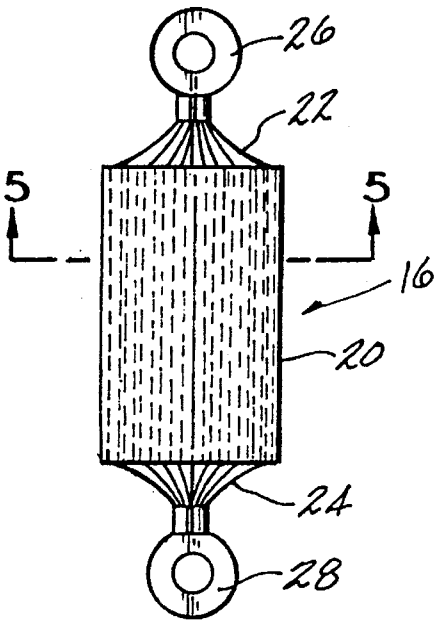
FIG. 4 is an elevational view of another embodiment of the invention which is designed for use in essentially dry environment applications.
Figure 5:
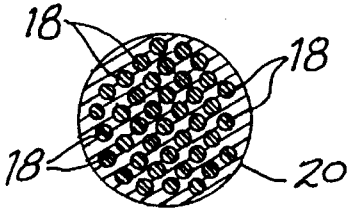
FIG. 5 is a sectional view taken along line 5—5 of FIG. 4.

Referring to FIGS. 4 and 5, yet another embodiment of a device designed for use in essentially dry environmental applications is shown. The device is denoted generally by the numeral 16 and includes a plurality of cathodic members 18 which extend through and are enveloped by an anodic member 20. The cathode members 18 are separated from each other internally of the anode member 20 and each cathode member 18 is completely surrounded by the anode. The cathode members 18 can be heavy duty copper conductor wire or the like, and the anode 20 can be zinc, aluminum, or some other electron donor metal. On each end of the anode member 20, the individual cathodes 18 are gathered together as at 22 and 24 and are all connected to respective leads 26 and 28 which form connections for securing the device 16 to a structure to be protected. By providing a plurality of separated cathode members 18, the surface area of the anode-cathode interface is enhanced so as to provide an increased area for sacrificial corrosion without unduly enlarging the overall device 16.

Figure 6:
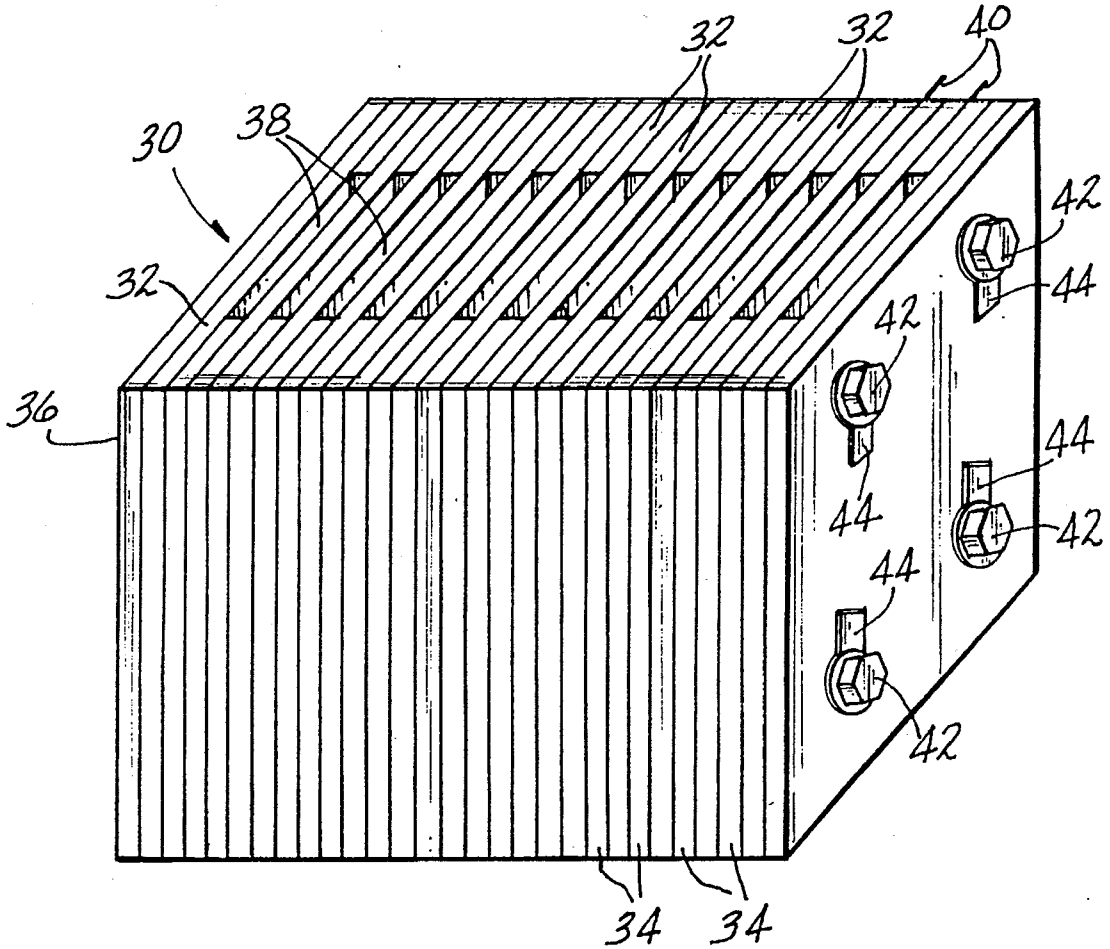
FIG. 6 is a perspective view of an embodiment of the invention which is designed for use in watery environment applications.

Referring now to FIG. 6, there is shown an embodiment of the invention which may be used in either an essentially dry environmental application, or in watery environmental applications. The device is denoted generally by the numeral 30 and includes a stack of anodic metal plates 32 with intermittant cathodic plates 34 interposed between adjacent anode plates 32. At each end of the stack 30 there are disposed end plates 36 which are formed from the cathodic metal. The internal cathode plates 34 are smaller than the anode plates 32 and are arranged so as to contact edge portions only of the anode plates 32. In this manner interior water channels 38 are formed between each of the anode plates 32. The cathode plates 34 may have leads 40 connected to them, or they may be grounded by conductive bolts 42 which extend through the stack 30 and are used to press the anode plates 32 and cathode plates 34 together, and to electrically interconnect the plates 32 and 34. Leads 44 may be provided on each bolt 42 for connecting the stack 30 to the structure to be protected. The alternating cathode-anode plates 32 and 34 are operable to sacrificially corrode in the essentially dry environment, and the portions of the anode plates 32 bounding the water channels 38 will sacrificailly corrode in the watery environment.

Figure 7:
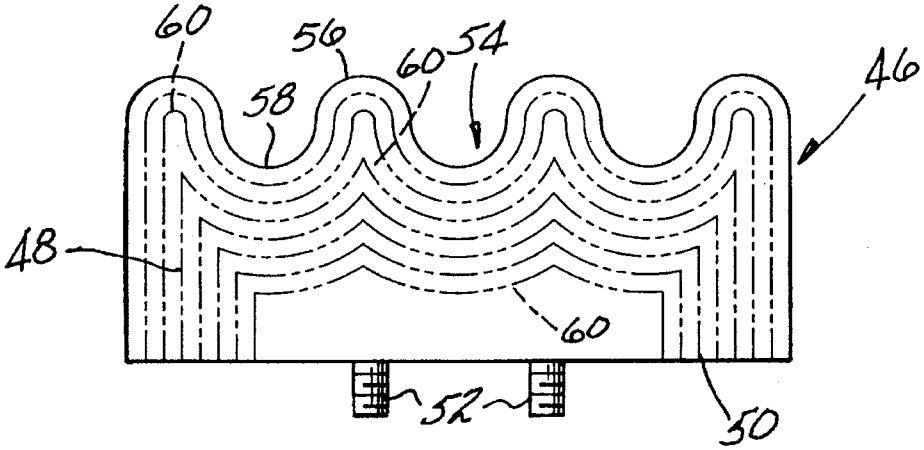
FIG. 7 is a side view of another embodiment of the invention which is designed for use in watery environment applications.

FIG. 7 shows an embodiment of a sacrificial anode which is designed for use in a watery environment, and which is denoted generally by the numeral 46. The device 46 consists of a block of anodic metal 48 which has a first surface 50 that is adapted to be secured to the structure being protected. Bolts 52 may be provided to facilitate securement of the block 48 to the structure being protected, The block 48 has an opposite undulating surface 54 provided with alternating ridges 56 and valleys 58 that serve to optimize the area of the surface 54. Phantom lines 60 illustrate successive sacrificial corrosion generations which will occur on the surface 54 of the block 48. It will be noted that as the block 48 corrodes, the area of the corroding surface 54 will continue to be optimized relative to the size of the block 48.

Figure 8:
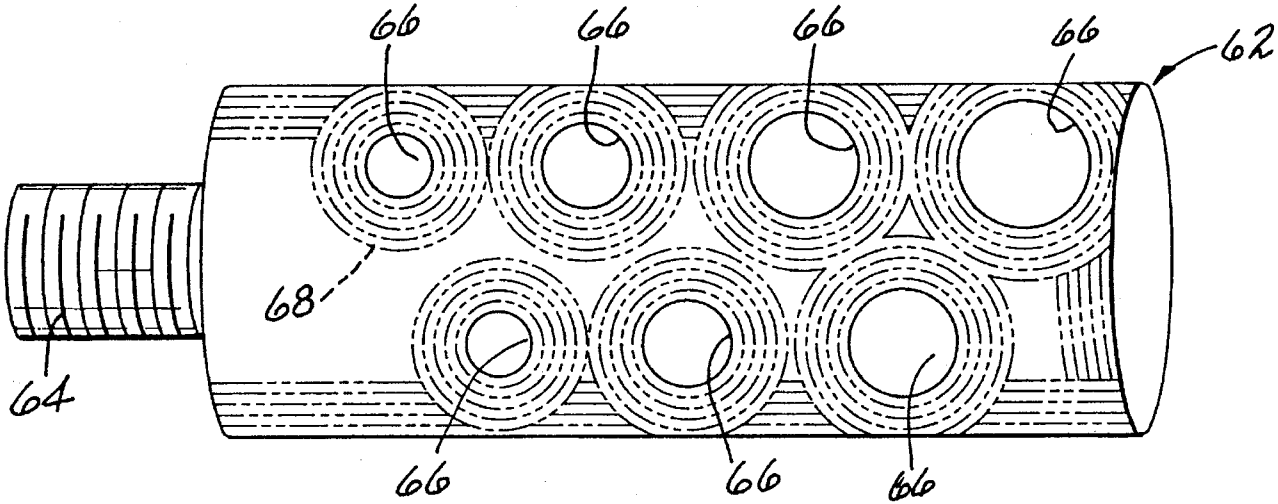
FIG. 8 is a side view of another embodiment of the invention which is designed for use in watery environment applications.

FIG. 8 illustrates a second embodiment of a sacrificial anode which is also designed for use in a watery environment, and which is denoted generally by the numeral 62. The anode 62 takes the general shape of a cylinder and has one end thereof which is provided with a threaded boss 64 that facilitates securement of the anode 62 to the structure being protected. The anode 62 has a plurality of transaxial through passages 66 formed therein which passages 66 serve to optimize the surface area of the anode 62 that will be subjected to sacrificial corrosion. It will be noted that the diameter of the passages 66 increases as the distance from the passages 66 to the threaded end of the anode 62 increases. Thus the diameter of the passages 66 most distal of the threads 64 will be larger than the diameter of the passages 66 most proximal to the threads 64. In this way, the degree of sacrificial corrsion of the anode 62 will increase distally of the threaded end of the anode. The anode 62 will thus gradually shrink back toward the threads 64 as it corrodes. Phantom lines 68 illustrate successive generations of sacrificial corrosion of the anode 62 around the passages 66 and along the sides of the anode. Both of the anodes 48 and 62 are formed from electron donor metals such as zinc, aluminum, magnesium or the like.

It will be readily appreciated that by optimizing the surface area of the anode which will sacrificially corrode, enhanced service life and operating efficiency can be obtained. The ability to easily attach and detach the sacrificial device to and from the structure being protected makes the device simple to use and readily replaceable when necessary. The portion of the device which actually contacts the structure being protected is distal of the corroding surfaces on the device, so that the device will not corrosively adhere to the structure being protected.

Since many changes and variations of the disclosed embodiments of the invention may be made without departing from the inventive concept, it is not intended to limit the invention otherwise than as required by the appended claims.

What is claimed is:

1. A sacrificial anode device for protecting a metal structure from corrosion in an essentially dry environment, said device comprising:

a) an axially elongated cathode metal portion, said cathode metal portion having exposed opposite ends which are operable to be releasably secured to the metal structure, said cathode metal portion having a medial part with a stellate cross-sectional configuration comprising alternating peaks and valleys; and b) an anode metal cladding on said cathode metal portion and covering at least a fraction of said stellate part of said cathode metal portion, said anode metal cladding being disposed medially of said opposite ends of said cathode metal portion, and said anode metal cladding being intimately adhered to said cathode metal portion to form a fluted cathode-anode interface.

2. The device of claim 1 wherein said cathode metal portion has an axially extending corkscrew configuration.

3. The device of claim 1 wherein said cathode metal portion comprises a plurality of rods which are spaced apart from each other; and a single anode metal cladding, each of said rods being circumferentially surrounded by anode metal from said anode cladding so as to form a plurality of separate cathode-anode contact interfaces all within said single anode metal cladding.

4. A sacrificial anode device for protecting a metal structure from corrosion in an essentially dry environment, said device comprising:

a) a cathode which is made up of a plurality of metal rods which are axially elongated and formed with a stellate cross-section and which are transversely spaced apart from each other;

b) connections on opposite ends of said sacrificial anode device, which connections are adapted to be releasably secured to the metal structure being protected, each of said metal rods being conductively connected to said connections at both ends of said metal rods ;and c) a single anode cladding, said single anode cladding extending between said connections, and forming separate cathode-anode interfaces with each of said metal rods whereby a plurality of separate cathode-anode interfaces are formed within said single anode cladding.

* * * * *